US005460385A

United States Patent [19]

Lazzeroni

[11] Patent Number: 5,460,385

[45] Date of Patent: Oct. 24, 1995

[54] ATHLETIC GAME TRAINING AID

[76] Inventor: Denise Lazzeroni, 1325 Cass La. East, Westmont, Ill. 60559

[21] Appl. No.: 356,708

[22] Filed: Dec. 15, 1994

[51] Int. Cl.[6] ..... A63B 69/00

[52] U.S. Cl. ..... 273/411; 273/DIG. 19

[58] Field of Search ..... 273/411, 188 R, 273/189 R, DIG. 19

[56] References Cited

U.S. PATENT DOCUMENTS

| | | | |
|---|---|---|---|
| 2,093,153 | 9/1937 | McCarthy | 273/189 R |
| 3,101,196 | 8/1963 | Ferrara | 273/189 R X |
| 3,679,214 | 7/1972 | Boyte | 273/189 R |
| 4,537,394 | 8/1985 | Golinsky, Jr. | 272/117 |
| 4,575,089 | 3/1986 | Corbett et al. | 273/183 B |
| 4,795,163 | 1/1989 | Szabo | 273/411 |
| 5,149,099 | 9/1992 | Radakovich | 273/189 R |
| 5,165,696 | 11/1992 | Saha | 273/411 |
| 5,188,365 | 2/1993 | Picard | 273/189 R |

*Primary Examiner*—William H. Grieb
*Attorney, Agent, or Firm*—Welsh & Katz, Ltd.

[57] ABSTRACT

A flexible and adjustable training aid for use by all levels and sizes of athletes to teach and practice the proper body position while passing or moving to pass a volleyball. A harness on the athlete's torso and a leg member on the athlete's leg below the knee are connected by a low position member. Detachment of the low position member indicates failure to maintain proper low position. Other attachments indicate whether shoulders are far enough forward or legs are far enough apart.

20 Claims, 1 Drawing Sheet

ATHLETIC GAME TRAINING AID

BACKGROUND OF THE INVENTION

This invention relates in general to the field of athletic training aids, and more particularly to aids for training an athlete to maintain a predetermined body position during a play activity, especially activities in which the athlete should maintain bent knees while moving.

Passing is one of the skills which is most used and most difficult to learn in such sports as volleyball. When passing is done well in such sports, the athlete moves low in any direction, contacts the ball with forearms below the knees, shoulders forward, knees bent, and feet maintaining a wide stance. This form is especially important when the athlete is receiving a serve in volleyball, which is the most difficult ball to pass. However, the form is also useful in other play activities such as some wrestling or baseball activities.

A prior device described in the Gerald S. Szabo U.S. Pat. 4,795,163, issued 3 Jan. 1989, is a substantially rigid device designed to engage the athlete's arms and hands, and is not especially designed for training an athlete to maintain the proper position of the legs or of the arms and torso relative to the legs. The present invention will meet that need.

SUMMARY OF THE INVENTION

An object of the present invention is to assist an athlete in training to maintain the proper body position, including the proper position of the legs and of the arms and torso relative to the legs, particularly when passing or moving to pass in court games such as volleyball. Another object of the present invention is to provide a training aid which will remain comfortable and safe throughout a prolonged training exercise. A further object of the present invention is to provide a training aid with which athletes of all levels of ability can usefully learn and practice proper body position. A still further object of the present invention is to provide a training aid which can be adjusted for athletes of all sizes.

The athletic game training aid of the present invention is generally made of flexible material and is designed to engage the athlete's torso, shoulders, and legs. The aid comfortably harnesses the athlete into the proper passing position of wide stance, shoulders forward, and knees bent, and enables the athlete safely to pass many times in a row while moving in proper position. The aid includes a harness which is placed about the athlete's torso, a leg member to be placed about one of the athlete's legs preferably below the knee, or two leg members with one so placed about each of the athlete's legs, and a low position member connecting the harness to a leg member. If the athlete fails to maintain the proper low position, the low position member will detach indicating that failure to the athlete and any observers such as a coach. Optional additional elements can be included. A base member, joined at each of its two ends to a leg member, respectively, can indicate if the athlete failed to maintain legs far enough apart. A dangle, which may be, for example, an elongated member with one end connected to the harness and the other end weighted and free to swing, can indicate if the athlete failed to maintain shoulders far enough forward. Preferably, the aid is made to be adjustable for any size athlete.

DESCRIPTION OF A PRESENTLY PREFERRED EMBODIMENT

Figure 1:
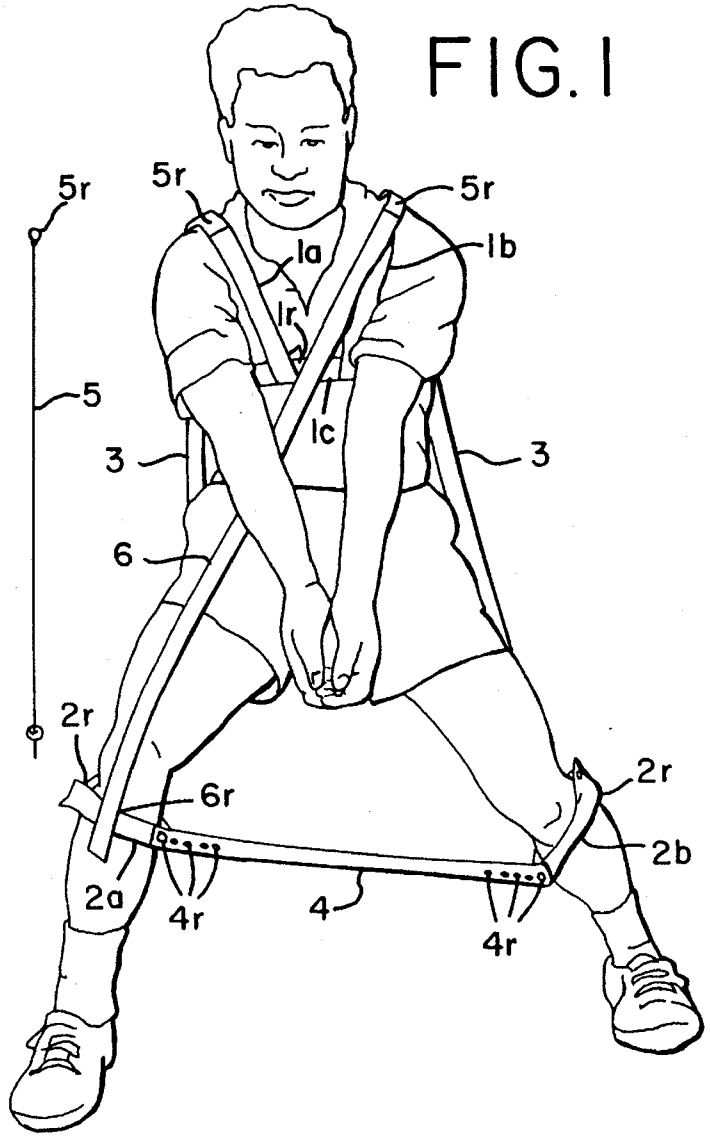
FIG. 1 is a front perspective view of an athlete wearing the athletic game training aid with base and low position members attached. An unattached dangle is also shown.

The athletic game training aid of the preferred embodiment of the invention includes a harness 1, right and left leg members 2*a* and 2*b*, two rear members 3, a base member 4, two shoulder dangles 5, and a low position member 6. These components may be made of any of many different materials. However, a cloth material is preferred for the harness 1 and leg members 2*a* and 2*b* for comfort and safety throughout prolonged use, and the dangles 5 may be made principally of any material which can be formed into a string-like component, with weights such as beads at their free ends.

Figure 2:
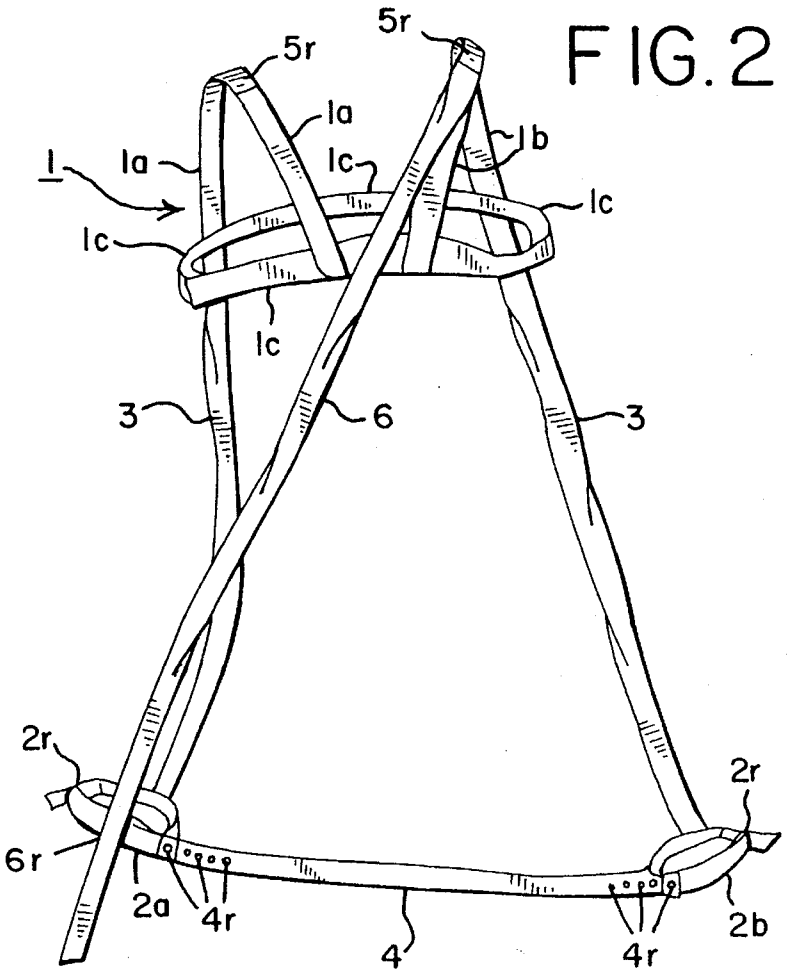
FIG. 2 is a front perspective view of the athletic game training aid with base and low position members attached.

The harness 1 includes a chest encircling portion 1*c* connected with right and left shoulder engaging portions 1*a* and 1*b*. Each shoulder engaging portion 1*a* or 1*b* and the part of the chest encircling portion 1*c* attached to that shoulder engaging portion 1*a* or 1*b* but not to the other one 1*b* or 1*a*, respectively, define an opening through which the athlete puts one arm, respectively. The harness 1 is secured or tightened with a suitable retaining means 1*r* (identification number in FIG. 1 shows location of retaining means which is not itself visible in the drawings) such as a Velcro® fastener on the chest encircling portion 1*c*. The leg members 2*a* and 2*b* are positioned just below the athlete's knees and secured or tightened with a suitable retaining means 2*r* (identification numbers in drawings show locations of retaining means which are not themselves visible in the drawings) such as Velcro® fasteners. Two rear members 3 connect the leg members 2*a* and 2*b* to the harness 1 (best seen in FIG. 2).

The low position member 6 extends between the harness 1 and one leg member 2*a* or 2*b*. In the drawings, the low position member 6 is illustrated as being permanently attached to the left shoulder engaging portion 1*b* of the harness 1 and as being attached to the right leg member 2*a* with a suitable easy-release retaining means 6*r* (identification number in drawings shows location of retaining means which is not itself visible in the drawings), such as a Velcro® fastener. The length of that part of the low position member 6 between the two attachments is made adjustable by known means, such as by using a long Velcro® strip on the low position member 6 as part of the easy-release retaining means 6*r*. While maintaining the correct body posture for the training exercise, the athlete adjusts the low position member 6 to remove any slack in it and fastens the easy-release retaining means 6*r*. Should the athlete's shoulders extend too high relative to the athlete's knees during the training exercise, the easy-release retaining means 6*r* will release, indicating the athlete failed to maintain the correct body posture.

Each shoulder engaging portion 1*a* or 1*b* of the harness 1 includes a suitable retaining means 5*r* (such as a hook, snap, or Velcro® fastener) for attaching the shoulder dangles 5 thereon. The athlete may observe the dangles 5 to see if the shoulders are being maintained in front of the knees.

The base member 4 is attached to the leg members 2*a* and 2*b* with suitable retaining means 4*r* such as snaps, and is made adjustable by known means such as by providing a series of snaps 4*r* extending along the length of base member 4. While maintaining the proper stance, the athlete adjusts the base member 4 to remove any slack in it and fastens retaining means 4*r*. The base member 4 serves as an indicator if the athlete is having a problem maintaining a wide stance, because the athlete can feel and observe if the base member 4 has any give during the training exercise.

This is a description of the presently preferred embodiment, but the invention is intended to encompass different variations, such as a low position member which has an easy-release retaining means at the shoulder, no rear member or an "X" shaped or upside down "Y" shaped rear member, different harness configurations, or a training aid with only a single leg member.

While a particular embodiment of the training aid of the invention has been shown and described, it will be appreciated by those skilled in the art that changes and modifications may be made thereto without departing from the invention in its broader aspects and as set forth in the following claims.

What is claimed is:

1. An athletic game training aid for training an athlete to maintain a predetermined position during a play activity, comprising:

a. a harness adapted to be placed about a portion of the athlete's torso, said harness having a retaining means for removably and adjustably retaining the harness substantially in position on the athlete's torso during relative movement of other portions of the athlete's body with respect to the portion of the torso on which the harness is retained;

b. at least one leg member to be removably and adjustably positioned on a lower leg portion of the athlete and having a means for retaining the member substantially in position on the athlete's leg during relative movement of other portions of the athlete's body with respect to the lower leg on which the member is retained; and c. at least one adjustable low position member with opposite first and second ends and extending from said harness to approximately a lower leg portion of the athlete and with the first end secured to the harness and the second end secured to the at least one leg member, whereby the length of the at least one low position member between the securements of the first and second ends is adjusted to train the athlete to maintain a predetermined position during a play activity.

2. A training aid as set forth in claim 1, wherein the securement of at least one of said first and second ends of the at least one low position member will release automatically if the athlete tends to extend the distance between the securements to an amount greater than the adjusted length between the securements.

3. A training aid as set forth in claim 1, wherein the harness has at least one shoulder engaging portion.

4. A training aid as set forth in claim 3, wherein the first end of said at least one low position member is secured to the at least one shoulder engaging portion of the harness.

5. A training aid as set forth in claim 1, wherein the harness has a chest encircling portion.

6. A training aid as set forth in claim 1, further comprising at least one rear member, with opposite rear member first and second ends, and with the rear member first end secured to the harness and the rear member second end secured to the at least one leg member.

7. A training aid as set forth in claim 1, wherein there are two leg members.

8. A training aid as set forth in claim 7, further comprising an adjustable base member with two opposite ends, each of the two opposite ends being secured to one of the leg members, respectively.

9. A training aid as set forth in claim 7, wherein there are two rear members, each with opposite rear member first and second ends, and with each of the rear member first ends secured to the harness and each of the rear member second ends secured to one of the leg members, respectively.

10. A training aid as set forth in claim 1, further comprising at least one dangle with opposite dangle first and second ends with the dangle first end secured to the harness and the dangle second end hanging free to indicate the position of the athlete's torso with respect to the athlete's legs.

11. A training aid as set forth in claim 1, wherein the harness has two shoulder engaging portions, and further comprising two dangles, each with opposite dangle first and second ends, and with each dangle first end secured to one of the shoulder engaging portions, respectively, and each dangle second end hanging free to indicate the position of the athlete's respective shoulder with respect to the athlete's legs.

12. A volleyball training aid for training an athlete to maintain a non-upright position during training for passing, comprising:

a. a harness adapted to be placed about a portion of the athlete's torso, said harness having a retaining means for removably and adjustably retaining the harness substantially in position on the athlete's torso during relative movement of other portions of the athlete's body with respect to the portion of the torso on which the harness is retained;

b. at least one leg member to be removably and adjustably positioned on a lower leg portion of the athlete and having a means for retaining the member substantially in position on the athlete's leg during relative movement of other portions of the athlete's body with respect to the lower leg on which the member is retained; and c. at least one adjustable low position member with opposite first and second ends and extending from said harness to approximately a lower leg portion of the athlete and with the first end secured to the harness and the second end secured to the at least one leg member, whereby the length of the at least one low position member between the securements of the first and second ends is adjusted to train the athlete to maintain a predetermined position when passing.

13. A training aid as set forth in claim 12, wherein the securement of at least one of said first and second ends of the at least one low position member will release automatically if the athlete tends to extend the distance between the securements to an amount greater than the adjusted length between the securements.

14. A training aid as set forth in claim 12, wherein the harness has at least one shoulder engaging portion.

15. A training aid as set forth in claim 14, wherein the first end of said at least one low position member is secured to the at least one shoulder engaging portion of the harness.

16. A training aid as set forth in claim 12, further comprising at least one rear member, with opposite rear member first and second ends, and with the rear member first end secured to the harness and the rear member second end secured to the at least one leg member.

17. A training aid as set forth in claim 12, wherein there are two leg members, and further comprising two rear members, each with opposite rear member first and second ends, and with each of the rear member first ends secured to the harness and each of the rear member second ends secured to one of the leg members, respectively.

18. A training aid as set forth in claim 17, further comprising an adjustable base member with two opposite ends, each of the two opposite ends being secured to one of the leg members, respectively.

19. A training aid as set forth in claim 12, further comprising at least one dangle with opposite dangle first and second ends, with the dangle first end secured to the harness and the dangle second end hanging free to indicate the position of the athlete's torso with respect to the athlete's legs.

20. A volleyball training aid for training an athlete to maintain a non-upright position during training for passing, comprising:

a. a harness adapted to be placed about a portion of the athlete's torso, said harness having a chest encircling portion, right and left shoulder engaging portions, and a retaining means for removably and adjustably retaining the harness substantially in position on the athlete's torso during relative movement of other portions of the athlete's body with respect to the portion of the torso on which the harness is retained;

b. right and left leg members to be removably and adjustably positioned respectively on lower leg portions of the athlete and having a means for retaining the members substantially in position on the athlete's legs during relative movement of other portions of the athlete's body with respect to the lower legs;

c. two rear members, each with opposite rear member first and second ends, and with each of the rear member first ends secured to the harness and each of the rear member second ends secured to one of the leg members, respectively;

d. an adjustable base member with two opposite ends, each of the two opposite ends being secured to one of the leg members, respectively;

e. two dangles, each with opposite dangle first and second ends, and with each dangle first end secured to one of the shoulder engaging portions, respectively, and each dangle second end hanging free to indicate the position of the athlete's respective shoulder with respect to the athlete's legs; and f. an adjustable low position member with opposite first and second ends and extending from said harness to approximately a lower leg portion of the athlete and with the first end secured to the left shoulder engaging portion of the harness and the second end secured to the right leg member, or vice versa, whereby the length of the low position member between the securements of the first and second ends is adjusted to train the athlete to maintain a predetermined position when passing and wherein the securement of at least one of said first and second ends of the low position member will release automatically if the athlete tends to extend the distance between the securements to an amount greater than the adjusted length between the securements.

* * * * *